US006223514B1

(12) United States Patent
Stahlecker

(10) Patent No.: US 6,223,514 B1
(45) Date of Patent: May 1, 2001

(54) APPARATUS FOR CONDENSING A DRAFTED FIBER STRAND

(75) Inventor: Hans Stahlecker, Haldenstrasse 20, 73079 Suessen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/488,825

(22) Filed: Jan. 21, 2000

(30) Foreign Application Priority Data

Jan. 27, 1999 (DE) ..... 199 03 113

(51) Int. Cl.[7] ..... D01H 5/28

(52) U.S. Cl. ..... 57/315; 57/328; 19/150; 19/246

(58) Field of Search ..... 19/150, 236–250, 19/252, 263, 286–288, 304–308; 57/304, 308, 315, 328, 333

(56) References Cited

U.S. PATENT DOCUMENTS 4,290,170 * 9/1981 Brookstein et al. ..... 19/236
4,953,349 * 9/1990 Fehrer ..... 57/315
5,085,046 * 2/1992 Fehrer ..... 57/315
5,090,192 * 2/1992 Stahlecker ..... 57/328
5,243,813 * 9/1993 Stahlecker ..... 57/328
5,285,624 * 2/1994 Stahlecker ..... 57/328
5,431,005 * 7/1995 Fehrer ..... 57/315
5,577,298 * 11/1996 Morell ..... 19/288
5,600,872 * 2/1997 Artzt et al. ..... 19/244
5,617,714 * 4/1997 Fehrer ..... 57/315
5,996,181 * 12/1999 Fuchs ..... 19/150

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

A condensing zone is arranged downstream of the front roller pair of a drafting arrangement of a spinning machine, in which condensing zone a drafted fiber strand is condensed. The condensing zone comprises a sliding surface having a suction slit, which sliding surface serves as a guide for a circulating air-permeable transport belt. The transport belt transports the fiber strand over the suction slit to a nipping roller, which presses the fiber strand and the transport belt against the sliding surface. The perforation of the transport belt presents a risk, namely that fiber fly or other impurities can be deposited between the sliding surface and the supporting surface of the transport belt arranged thereto. For this reason it is provided that the sliding surface has at least one sharp edge, which extends transversely to the transport direction and which scrapes the supporting surface. The sharp edge lies preferably in the area of the supporting surface which covers the suction slit.

35 Claims, 4 Drawing Sheets

21
20
27
18
19
12
A
B
28
25
41
23
11
22
24
14
42
27
13
17
C
IX

C
25
12
40
14
41
23
13
18

APPARATUS FOR CONDENSING A DRAFTED FIBER STRAND

BACKGROUND AND SUMMARY OF THE INVENTION

This application claims the priority of German patent application 199 03 113.4, the disclosure of which is expressly incorporated by reference herein.

The present invention relates to an apparatus for condensing a drafted fiber strand, comprising a suction device having a stationary sliding surface, also comprising a suction slit located in the sliding surface which suction slit extends essentially in transport direction, as well as a circulating, air-permeable transport belt which glides with a contact surface over the sliding surface, and which covers the suction slit while transporting the fiber strand over the suction slit.

An apparatus of this type is, for example prior art in German patent 197 41 441 C1. In this apparatus, the suction slit takes the form of a so-called NACA nozzle, which is not described in any detail. The aim is that as a result of the turbulences caused in the airflow at the unavoidable edges, a self-cleaning effect is achieved.

The above mentioned publication does not deal with the risk that fiber fly and trash can settle between the stationary sliding surface and the moving contact surface of the transport belt. Trash occurs in that single fibers of the fiber strand to be condensed, in particular the shorter fibers, reach with their front end in the area of the suction slit through the perforation of the transport belt into the inside. These fibers project then partly into the suction slit until the suction slit has been passed over. At best, the relevant fibers can be cut off at the end of the suction slit and the cut-off end sucked off; at worst, the fiber end is only turned over, so that it is not sucked off, but rather is transported further with the transport belt and lies partly between the contact surface and the sliding surface. The fiber can tear at any time and settle, dust-like somewhere on the contact surface or the sliding surface, in particular in the case of sticky fibers containing "honey dew". This results in the condensing effect being different from spinning station to spinning station, so that varyingly condensed fibers strands are delivered at the nipping points.

Condensing a drafted fiber strand, namely in an area to which the spinning twist is not retroactive, serves the purpose of bundling the fiber strand in its cross section and making it less hairy. This results, after the spinning twist has been imparted, in a smoother yarn with a higher tensile strength. When the desired condensing effect does not occur at even only one spinning station due to an impaired condensing zone, then the so-called Moire effect appears in the subsequent woven yarn, which renders the product a reject. It must be ensured therefore, that the condensing effect at the individual condensing zones of the spinning stations is constantly maintained.

It is an object of the present invention to ensure that the perforation of the transport belt does not become clogged and that no deposits can form in the area between the contact surface and the stationary sliding surface.

This object has been achieved in accordance with the present invention in that the sliding surface is provided with at least one sharp edge extending transversely to the transport direction, which sharp edge scrapes the contact surface at least in the area where it covers the suction slit.

By means of the sharp edge, fibers, whose turned-in ends project into the suction slit, are cut off so that they can be sucked off. The basic principle behind the present invention is that, at an exact defined point, in particular at the end of the suction slit, the contact surface of the transport belt is scraped from below. An edge of this kind can engage basically at any chosen point of the contact surface of the transport belt, but it is however purposeful to have the end of the suction slit in the form of this edge, as at this point the above mentioned problems are at their worst. By means of an edge bordering the suction slit, a fiber piece projecting into the suction slit can be shaved off and subsequently sucked off. The shortened fiber remaining on the transport belt finds its way back to the fiber strand and is transported off with the fiber strand after leaving the nipping point.

The suction slit can be in the form of a window closed on all sides and having a surrounding edge. The cutting-like edge thus surrounds the entire window and acts on the contact surface of the transport belt like a shaving device. It cannot happen that at this point a fiber is not cut off and drawn possibly further through the perforation, which would make the matter worse.

Alternatively or in addition, an edge can be applied at a distance from the suction slit to a separate suction opening, which edge then extends preferably over the entire width of the transport belt. In this case, the contact surface is not only shaved in the area which covers the suction slit, but is also kept clean over the entire effective width. The effect can be improved when the edge extends transversely to the transport direction, as the cutting effect is increased hereby. The separate suction ensures that the cut-off fiber ends are immediately drawn off. The suction effect can be increased when the contact surface in the area of the separate suction opening is free of any support, that is when the contact surface of the transport belt is not disposed at this point on the sliding surface. If a suction nozzle is arranged in addition to the suction opening on the side of the transporting belt facing away from the contact surface, the perforated transport belt can be suctioned in the area of the edge from both sides.

The material of the sharp edge must, of course, be hard enough in order that it does not wear. If, because of the necessary sliding properties of the stationary sliding surface, the material does not meet this requirement, then it is purposeful to provide a suitable coating. If the coating is very thin, this will not impair the sharpness of the edge.

Instead of a coating, the sliding surface can be provided with a flexible stocking-like coat, which is provided with at least one recess for forming the at least one edge. The stocking-like coat must be made of sufficiently strong yet thin material. The recess is located for the purpose of the present invention in the area of the suction slit, which is again in the form of a window. The periphery of the recess is hereby advantageously somewhat smaller than the periphery of the suction slit, so that the suction slit is bordered on all sides by a sharp edge.

Alternatively the sliding surface can be surrounded by a thin metal foil, which is provided with at least one recess for forming the at least one edge. This metal foil can be adhered or clipped on. It should have a thickness of between 0.2 mm and 0.5 mm, so that the edge remains sufficiently sharp. The recess is so chosen that it is disposed on the suction slit, but reduces, window-like, the size of the slit all around. In particular the end of the suction slit should be reduced in size by the metal foil, as the sharp edge is particularly effective at this point.

The metal foil can have open impact points, which are located in the area of a concave dent in the sliding surface.

The metal foil can be made as an open metal strip, which corresponds to the periphery of the stationary sliding surface. At the dented area, the metal foil is raised from the contact surface somewhat so that the transport belt is not subject at this point to any significant friction. At such a concave dent, the impact points of the metal foil are not damaging.

Other objects, advantages and novel features of the present invention will become apparent from the following detailed description of the invention when considered in conjunction with the accompanying drawings.

DETAILED DESCRIPTION OF THE DRAWINGS

Figure 1:
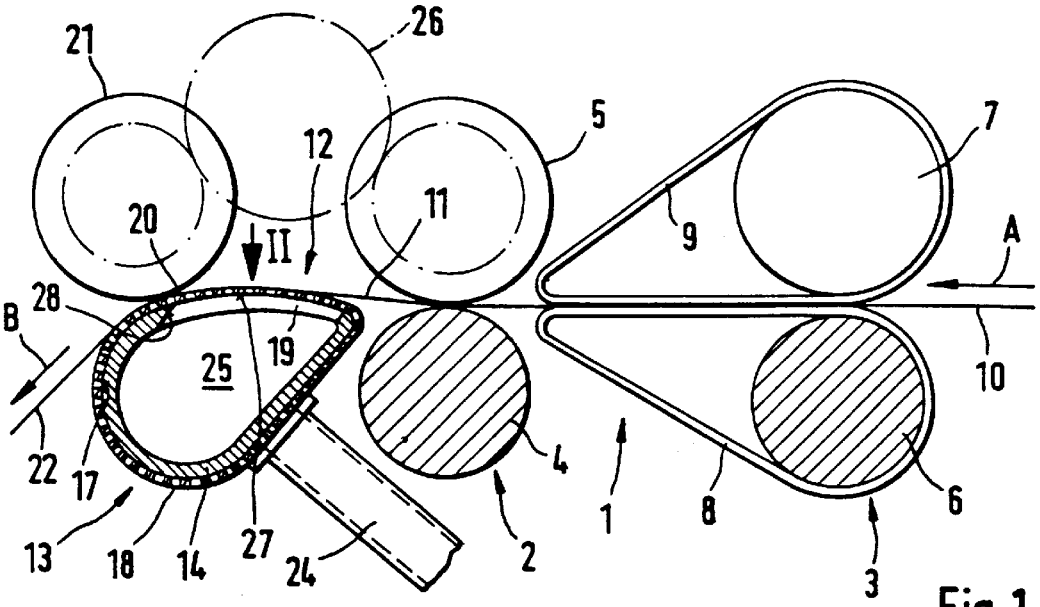
FIG. 1 is a partly sectioned side view of the area of a condensing zone, constructed in accordance with a preferred embodiment of the present invention.

Of a drafting apparatus 1 of a spinning station of a ring spinning machine, only the front roller pair 2 and the apron roller pair 3 upstream thereof are shown in FIG. 1. The front roller pair 2 comprises a driven bottom cylinder 4, which extends over a plurality of spinning stations, as well a top roller 5 arranged at each spinning station. In a similar way, the apron roller pair 3 comprises a driven bottom cylinder 6 as well as a top roller 7 per spinning station. A bottom apron 8 and a top apron 9 can also be seen.

In the drafting apparatus 1, a sliver or roving 10 is transported in a known way in transport direction A and thus drafted to the desired degree of fineness. Downstream of the front roller pair 2 lies a drafted, but still spinning twist free fiber strand 11, see also FIG. 2.

Figure 2:
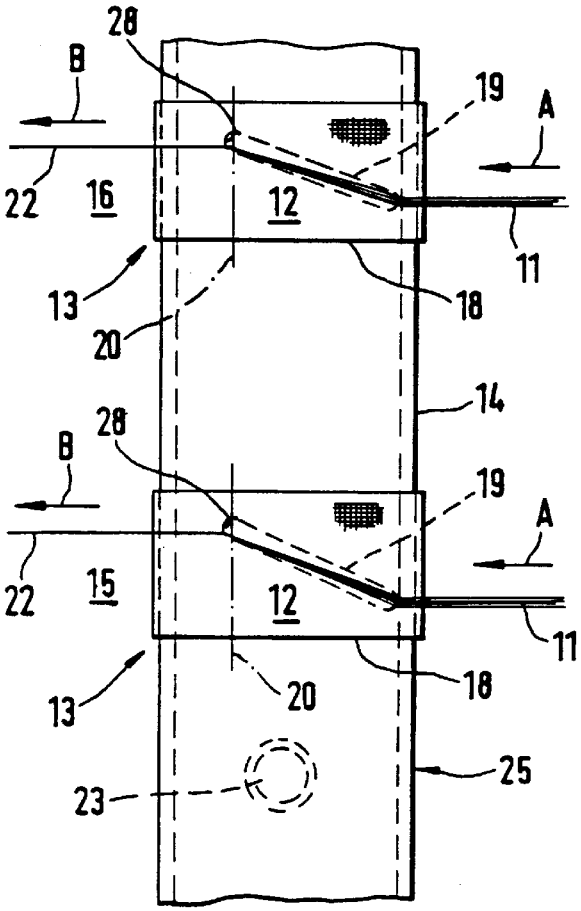
FIG. 2 is a view in the direction of arrow II of FIG. 1 onto the condensing zone.

A condensing zone 12 is arranged downstream of the drafting apparatus 1, at which condensing zone 12 an apparatus 13 for condensing the fiber strand 11 is arranged. As can be seen in FIG. 2, the apparatus 13 comprises a hollow profile 14, which extends over a plurality of spinning stations 15,16. The outer contour of the hollow profile 14 is a stationary sliding surface 17, at which a transport belt 18 is arranged per spinning station 15,16.

The transport belt 18 of the condensing zone 12 is air-permeable and consists preferably of a close-meshed woven material of polyamide threads. The transport belt 18 transports the fiber strand 11 to be condensed through the condensing zone 12 and over a suction slit 19 of the sliding surface 17. The suction slit 19 is somewhat wider than the already condensed fiber strand 11 and is arranged in transport direction A slightly inclined, so that the fiber strand 11 obtains a light false twist during condensing. The suction slit 19 extends to a nipping point 20, which is formed between a nipping roller 21 and the sliding surface 17 of the hollow profile 14, and which borders the condensing zone 12 on its exit side. The nipping roller 21 presses the fiber strand 11 and the transport belt 18 against the sliding surface 17.

Downstream of the nipping point 20 a yarn 22 extends, to which a spinning twist is applied. The nipping roller 21 serves as a twist block for the spinning twist, so that the fiber strand 11 in the condensing zone 12 is twist-free. Downstream of the nipping point 20, the yarn 22 is delivered in delivery direction B to a ring spindle (not shown).

The hollow profile 14 comprises per machine section an opening 23, which is connected to a vacuum source (not shown) by means of a suction tube 24, and which opening is thus a component part of the suction device 25. Thus a suction effect is exerted through the perforated transport belt 18 on the fiber strand 11 to be condensed.

The nipping roller 21 is connected to a drive, which is transferred by means of a transfer roller 26, denoted only by a dot-dash line, from the top roller 5 of the front roller pair 2. The circumferential speed of the nipping roller 21 is hereby slightly greater than the circumferential speed of the front roller pair 2.

The transport belt 18 is provided on its side facing away from the fiber strand 11 with a contact surface 27, which slides on the stationary sliding surface 17. There is a risk that between the contact surface 27 and the sliding surface 17, fiber fly and trash may settle. The front ends of individual fibers namely, in particular short fibers, can project through the perforation of the transport belt 18 inwards into the suction slit 19. If such fibers are turned up at the end of the suction slit 19, they will then reach the area between the contact surface 27 of the transport belt 18 and the stationary sliding surface 17. This leads in time to an impairment of the condensing effect of the respective condensing zone 12.

In order to circumvent the above mentioned disadvantage, the suction slit 19 is bordered at its end by a sharp edge 28. The edge 28 extends transversely to the transport direction A and is in a position to cut off the fiber ends projecting through the perforation of the transport belt 18 into the suction slit 19, so that these cut-off ends can then be sucked off. The contact surface 27 of the transport belt 18 is thus scraped in the area of the edge 28 of the suction slit 19 from below. The remaining fibers in the fiber strand 11 are fed with the fiber strand 11 by way of the nipping point 20 in the desired way to the ring spindle.

Figure 3:
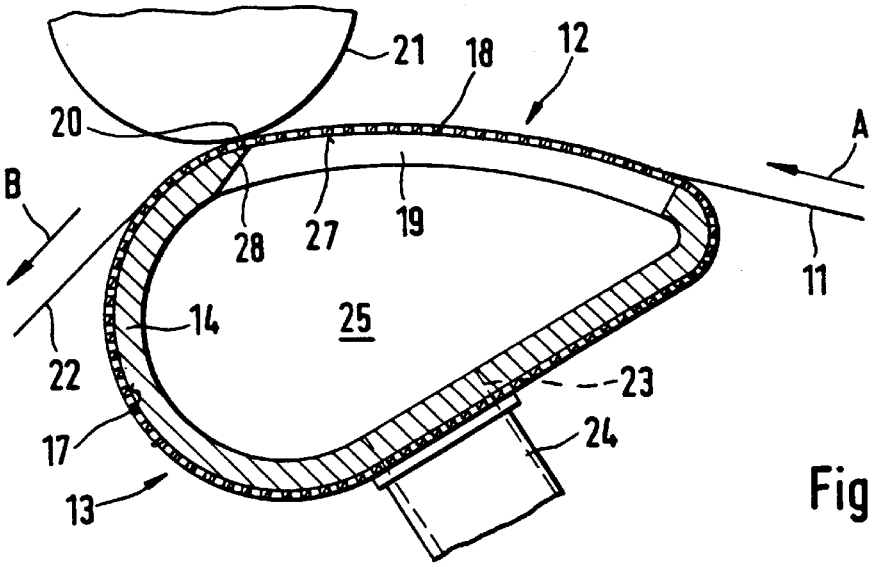
FIG. 3 is an enlarged representation of the condensing zone of FIG. 1.

In FIG. 3, which is an enlarged section from FIG. 1, the area of the sharp edge 28 can be seen more clearly. It can be seen that this edge 28 borders the suction slit 19 in transport direction A.

Figure 4:
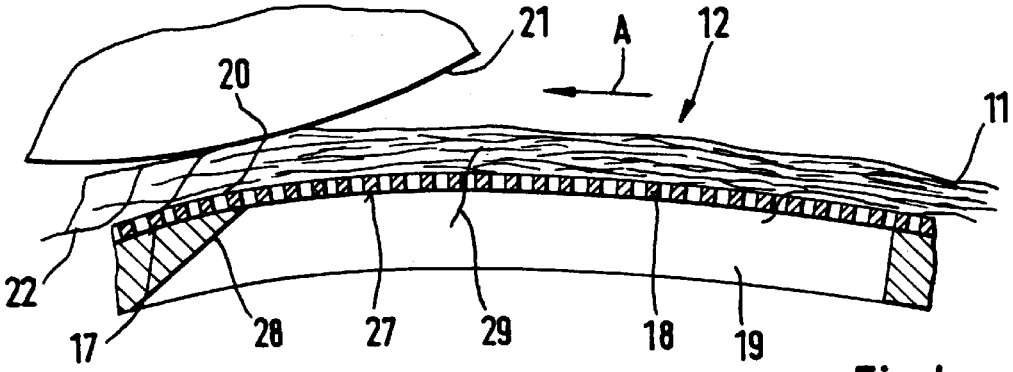
FIG. 4 is a greatly enlarged representation of the area of the suction slit of FIG. 3.

The process is described in more detail with the aid of the greatly enlarged FIG. 4, which is in turn a section from FIG. 3.

The perforated transport belt 18, which transports the fiber strand 11 to be condensed in transport direction A through the condensing zone 12 to the nipping point 20, can be seen. The spinning twist of the thread or yarn 22 begins from the nipping point 20 on. A fiber 29 is shown, which has penetrated the perforation of the transport belt 18 with its front end, and projects partly into the suction slit 19. This part of the fiber 29 is shaved off at the sharp edge 28, so that it can be sucked off. The rest of the fiber 29 is, during further transportation, pulled upwards out of the perforation again and reaches, as it should, into the yarn 22. As the thickened contours show, at least the edge 28 must be provided with a suitable wear-resistant coating, but preferably the entire sliding surface 17 is coated.

Figure 5:
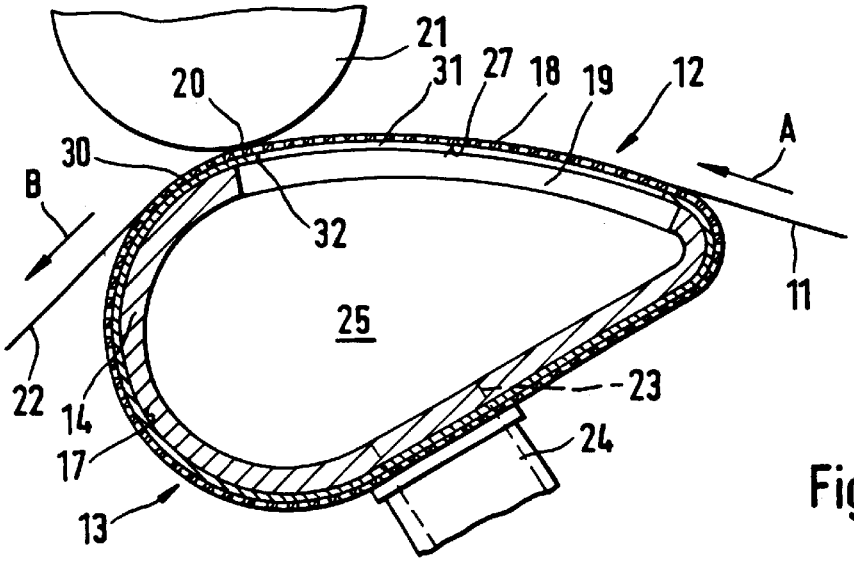
FIG. 5 is a view similar to FIG. 3 having a stationary sliding surface, which is provided with a stocking-like coat, constructed according to another preferred embodiment of the invention.

According to the embodiment of the present invention in FIG. 5, the sliding surface 17 is provided with a flexible stocking-like coat 30, which is made of sufficiently strong and thin material. The coat 30 has a recess 31 in the area of the suction slit 19 and forms at least at the end of the suction slit 19 a sharp edge 32, which reduces the suction slit 19 in size at its exit side. This edge 32 may surround the suction slit 19 like a window. The edge 32 formed by the stocking-like coat 30 has the same purpose as the edge 28 in the Figures described above.

Figure 6:
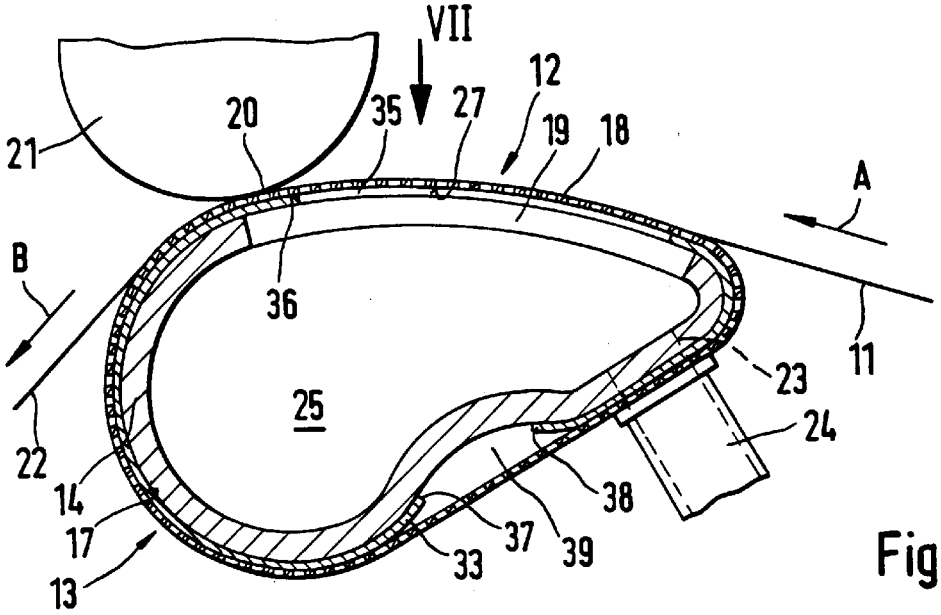
FIG. 6 is a view similar to FIGS. 3 and 5 having a stationary sliding surface, which is surrounded by a metal foil, constructed according to another preferred embodiment of the invention.
Figure 7:
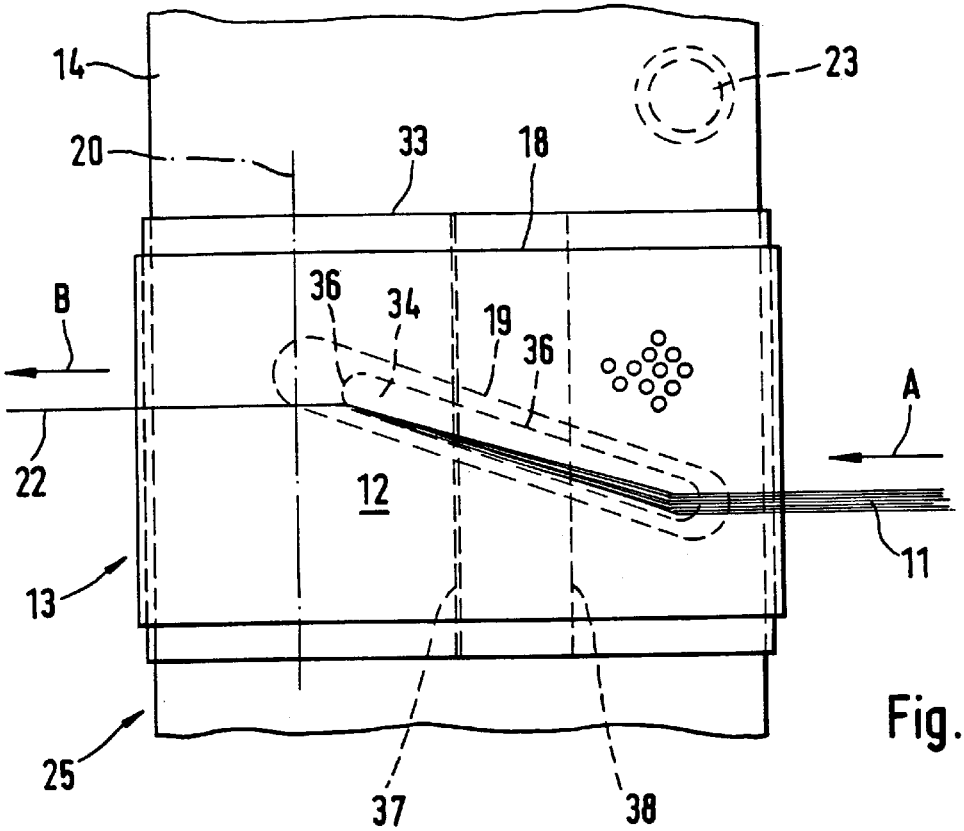
FIG. 7 is a view in the direction of the arrow VII onto the condensing zone of FIG. 6.

In the embodiment according to FIGS. 6 and 7, the sliding surface 17 is surrounded by a thin metal foil 33, which has a thickness of approximately between 0.2 mm and 0.5 mm. The metal foil 33 is provided with a window-like recess 35 adapted to the contour of the suction slit 19, and forms an edge 36 all around, as the recess 35 is somewhat smaller than the periphery of the suction slit 19. In particular at the exit of the suction slit 19, the edge 36 is clearly noticeable. This edge 36 processes in a way descibred above any fiber ends which project into the suction slit 19, which fibers ends are then cut off and sucked off. This effectively prevents the turned up fiber ends from settling between the contact surface 27 of the transport belt 18 and the stationary sliding surface 17.

For technical reasons, the metal foil 33 is in the form of an open steel belt, which has, at a distance from the suction slit 19, two impact points 37 and 38. These impact points 37,38 are located in the area of a concave dent 39 of the sliding surface 17, so that they do not come into contact with the contact surface 27.

Figure 8:
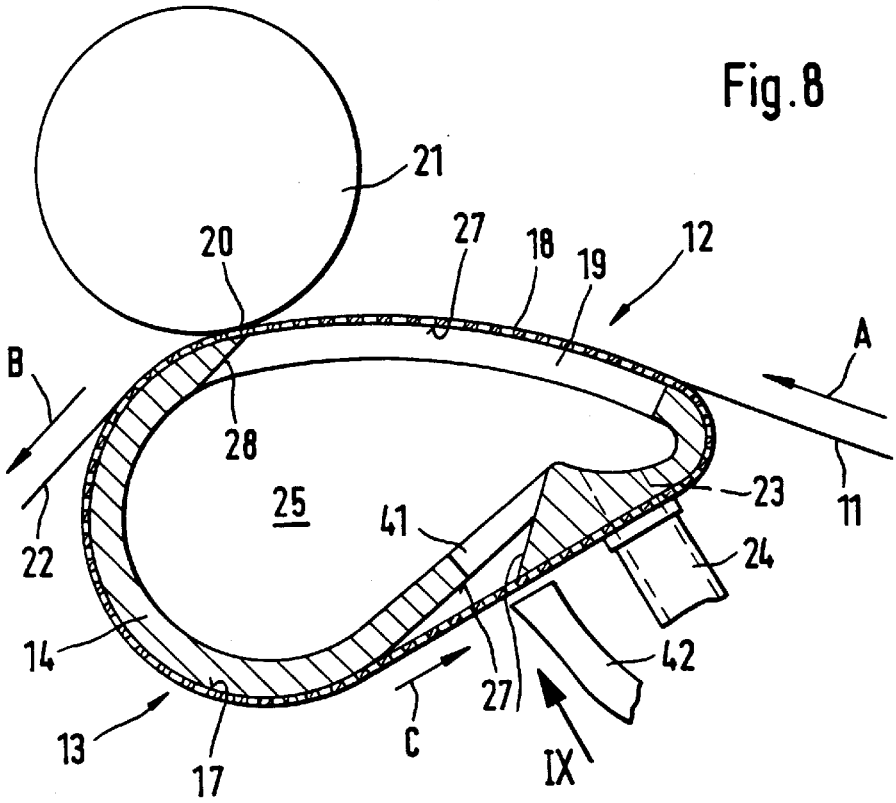
FIG. 8 is a view similar to FIG. 3 onto a stationary sliding surface, which is provided at a distance from the suction slit with an additional edge, constructed according to another preferred embodiment of the invention.
Figure 9:
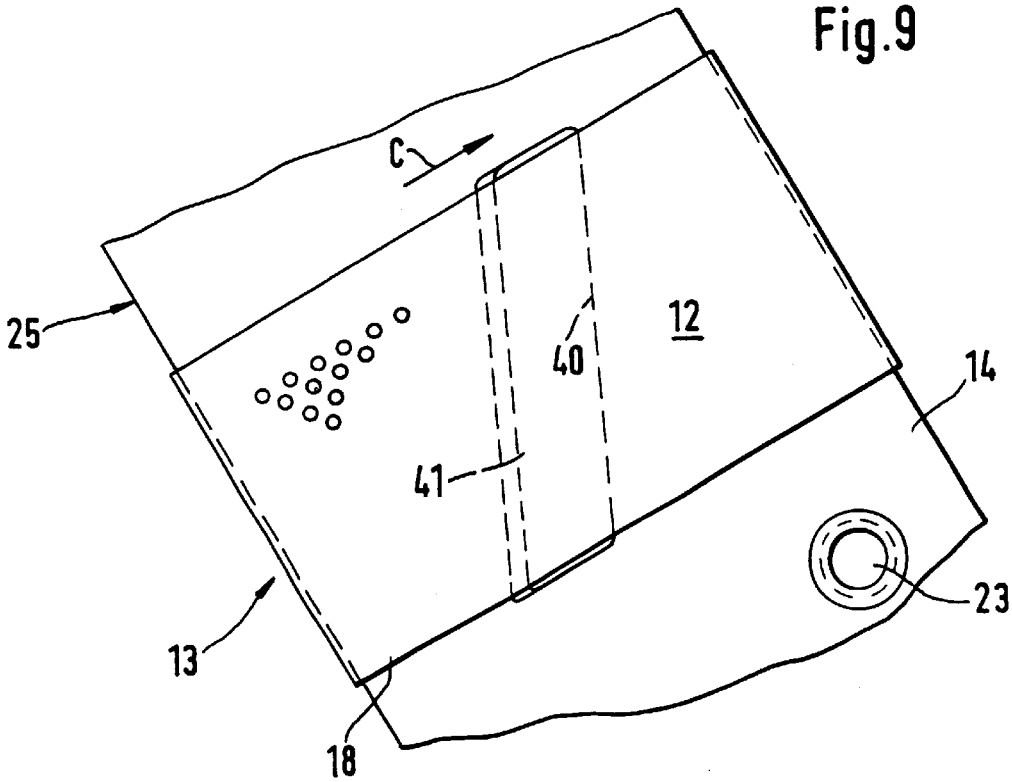
FIG. 9 is a view in the direction of the arrow IX onto the additional edge of FIG. 8.

According to the embodiment of the present invention according to FIGS. 8 and 9, a sharp edge 28 is again present, which was already described with the aid of the FIGS. 1 to 4 and which borders the suction slit 19 on its exit side in transport direction A. In addition, an additional edge 40 is provided at a distance from the suction slit 19, which edge 40 extends over the entire width of the contact surface 27 of the transport belt 18. This can be seen clearly in FIG. 9, which shows a view from below of the FIG. 8.

The additional edge 40 extends tranversely to the transport direction A, or, in opposite direction C of the ends of the transport belt 18 returning at this point. This increases the cutting effect. At the edge 40, the areas of the contact surface 27, on which the narrower edge 28 does not act, are also scraped. A separate suction opening 41 is arranged at the edge 40, at which the shaved off fiber ends are immediately sucked off. The contact surface 27 has no support at all in the area of the suction opening 41, which increases the suction effect. In addition, a suction nozzle 42 can be arranged at the suction opening 41 on the side of the transport belt 18 facing away from the contact surface 27, so that the transport belt 18 is suctioned at this point from both sides.

It is self-evident that the embodiment according to FIGS. 8 and 9 can also here, in a way not shown, be provided with a coating, a stocking-like flexible coat 30 or a thin metal foil 33.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for condensing a drafted fiber strand, comprising:

a suction device having a stationary sliding surface, a suction slit located in the sliding surface in a path of the fiber strand, and a circulating, air-permeable transport belt which glides with a contact surface over the sliding surface and which covers the suction slit while transporting the fiber strand over the suction alit, wherein the sliding surface is provided with at least one sharp edge extending substantially transversely to a transport direction of the fiber strand, said sharp edge being located to scrape the contact surface at least in the area which covers the suction slit.

2. An apparatus according to claim 1, wherein the sharp edge borders the suction slit in the transport direction (A).

3. An apparatus according to claim 2, wherein the suction slit is a window having a surrounding edge.

4. An apparatus according to claim 2, wherein the sliding surface is provided with a wear-resistant coating.

5. An apparatus according to claim 2, wherein the sliding surface is provided with a flexible, stocking-like coat, which is provided with at least one recess for forming the at least one sharp edge.

6. An apparatus according to claim 2, wherein the sliding surface is enclosed in a thin metal foil, which is provided with at least one recess for the formation of the at least one sharp edge.

7. An apparatus according to claim 1, wherein the suction slit is a window having a surrounding edge.

8. An apparatus according to claim 7, wherein the sliding surface is provided with a wear-resistant coating.

9. An apparatus according to claim 7, wherein the sliding surface is provided with a flexible, stocking-like coat, which is provided with at least one recess for forming the at least one sharp edge.

10. An apparatus according to claim 7, wherein the sliding surface is enclosed in a thin metal foil, which is provided with at least one recess for the formation of the at least one sharp edge.

11. An apparatus according to claim 1, wherein the edge is applied to a separate suction opening at a distance from the suction slit, said edge extending preferably over the entire width of the transport belt.

12. An apparatus according to claim 11, wherein the edge extends transversely to the transport direction (A).

13. An apparatus according to claim 12, wherein the contact surface is free of any support in the area of the suction opening.

14. An apparatus according to claim 11, wherein the contact surface is free of any support in the area of the suction opening.

15. An apparatus according to claim 11, wherein a suction nozzle is arranged on a side of the transport belt facing away from the suction opening.

16. An apparatus according to claim 15, wherein the edge extends transversely to the transport direction (A).

17. An apparatus according to claim 16, wherein the contact surface is free of any support in the area of the suction opening.

18. An apparatus according to claim 11, wherein the sliding surface is provided with a wear-resistant coating.

19. An apparatus according to claim 1, wherein the sliding surface is provided with a wear-resistant coating.

20. An apparatus according to claim 1, wherein the sliding surface is provided with a flexible, stocking-like coat, which is provided with at least one recess for forming the at least one sharp edge.

21. An apparatus according to claim 1, wherein the sliding surface is enclosed in a thin metal foil, which is provided with at least one recess for the formation of the at least one sharp edge.

22. An apparatus according to claim 21, wherein the metal foil has open impact points, which are located in the area of a concave dent of the sliding surface.

23. An apparatus according to claim 1, wherein said suction slit is skewed with respect to the transport direction.

24. Support apparatus for a perforated fiber strand carrying belt of a condensing device, comprising:

a hollow body member with an exterior facing sliding surface operable to slidably support a perforated fiber strand carrying belt, said hollow body member having a suction slit opening in use to a condensing zone for the fiber strand, and a sharp edge at the hollow body member which in use is operable to cut ends of fibers protruding in through the perforated belt.

25. Support apparatus according to claim 24, wherein the sharp edge is provided at a fiber strand flow downstream edge of the suction slit opening.

26. Support apparatus according to claim 24, wherein the sharp edge is provided on a metal foil coating the hollow body member.

27. Support apparatus according to claim 24, wherein the sharp edge is provided on a flexible stocking-like coat of the hollow body member.

28. An apparatus for condensing a drafted fiber strand, comprising a suction device having a stationary surface with a suction slit therein so as to be locatable in a path of the fiber strand, and an air-permeable transport belt arranged to slide over the stationary surface to transport the fiber strand and to cover the suction slit over which the fiber strand is transported, wherein the stationary surface includes a metal foil with a window-shaped recess in an area of the suction slit.

29. An apparatus according to claim 28, wherein the window-shaped recess is sized to be smaller than a periphery of the suction slit.

30. An apparatus according to claim 28, wherein the metal foil has opposed end edges.

31. An apparatus according to claim 30, wherein the opposed end edges are configured to engage in an indentation in the suction device.

32. An apparatus for condensing a drafted fiber strand, comprising a suction device having a stationary surface with a suction slit therein so as to be locatable in a path of the drafted fiber strand, an air-permeable transport device having a contact surface arranged to slide over the stationary surface to transport the fiber strand and to cover the suction slit, and means associated with the stationary surface to scrape the contact surface at least in an area which covers the suction slit.

33. An apparatus for condensing a drafted fiber strand, comprising a suction device having a stationary surface with a suction slit therein locatable in a path of the fiber strand, air-permeable transport device having a contact surface for sliding over the stationary surface, and means removably arranged over the stationary surface, said means being a metal foil with a window-shaped recess in an area of the suction slit.

34. An apparatus according to claim 33, where the recess of the removable means is sized to be smaller than a periphery of the suction slit.

35. An apparatus according to claim 33, wherein the metal foil has opposed end portions engageable in an indentation of the suction device.

* * * * *